US007471497B1

(12) United States Patent
Knight, Sr. et al.

(10) Patent No.: US 7,471,497 B1
(45) Date of Patent: Dec. 30, 2008

(54) ELECTROSTATIC DISCHARGE PREVENTION DEVICE

(76) Inventors: William C. Knight, Sr., 3402 Willow St., Bonita, CA (US) 91902; Teri L. Knight, 3402 Willow St., Bonita, CA (US) 91902

( * ) Notice: Subject to any disclaimer, the term of this patent is extended or adjusted under 35 U.S.C. 154(b) by 0 days.

(21) Appl. No.: 11/787,294

(22) Filed: Apr. 16, 2007

(51) Int. Cl.
*H05F 3/00* (2006.01)

(52) U.S. Cl. ..... 361/224; 361/223; 361/212

(58) Field of Classification Search ..... 361/220, 361/223–224, 212; 36/25, 30 R, 45, 84, 36/87

See application file for complete search history.

(56) References Cited

U.S. PATENT DOCUMENTS 2,712,099 A * 6/1955 Legg ..... 361/224
3,686,357 A * 8/1972 Cheeseman ..... 525/477
4,727,452 A * 2/1988 Brownlee ..... 361/224
6,549,391 B1 * 4/2003 Bisson ..... 361/223
6,982,861 B2 * 1/2006 Lee et al. ..... 361/223

FOREIGN PATENT DOCUMENTS

JP 02005327944 A * 11/2005

* cited by examiner

*Primary Examiner*—Stephen W Jackson
*Assistant Examiner*—Terrence R Willoughby
(74) *Attorney, Agent, or Firm*—Richard D. Clarke

(57) ABSTRACT

The present invention provides a device that can be readily installed in any type of footwear, and that when installed enables a semi-continuous grounding path through the shoe of the wearer to an earthly source to dissipate static electricity. The present invention consists of a collection pad, an electrical path to a resistor, and continues that path to an earthly ground that prevents, or greatly reduces, electro static discharge (ESD) in personnel and their clothing when they are wearing shoes with insulative-soles. Alternatively a single resistor wire is employed to conduct static electricity to ground. This device is intended to increase the comfort level of the wearer of such shoes by eliminating, or greatly reducing the harmful and annoying effects of ESD without having any affect on the cosmetic appearance or the functionality of the shoe.

18 Claims, 2 Drawing Sheets

ELECTROSTATIC DISCHARGE PREVENTION DEVICE

FIELD OF THE INVENTION

The present invention is related to the field of electrostatic discharge prevention devices. More particularly the present invention provides a semi-continuous path to an earthly ground by adding it to one or more of the wearer's shoes. Thus, preventing, or greatly reducing, the accumulation of electrostatic charges in the wearer's clothing and body.

BACKGROUND OF THE INVENTION

The problem of electrostatic discharge (ESD) is well known and almost everyone has experienced it while wearing shoes with non-conductive soles, walking across a carpet, for example, and touching a grounded object such as a doorknob. The average consumer's concerns about the comfort in both the home and workplace have never been addressed by either the shoe manufacturers or by any of the other referenced patents. The current invention is primarily to address that need. The present invention will also aid in reducing ESD and accumulation of static electricity in the body and clothing that can also cause clothing to adhere to the body and can cause embarrassment or at least an uncomfortable feeling in the wearer.

Many employers now allow employees to wear their casual shoes to work in a carpeted office environment and as a result there has been a dramatic increase of office workers that are experiencing ESD, which further increases the need to dissipate ESD to eliminate annoying and uncomfortable ESD events.

Rubber soles, and later other man made materials, have been used on many types of shoes for almost 100 years. These soles reduced costs, provide greater traction, provide consistency; as well as good wear characteristics, and moisture resistance. They also provide insulation of the body from a source of an earthly ground. Almost since these soles were adopted by industry, the insulative quality of these soles has been both a problem and in some cases a benefit for the wearer of such footwear.

For the electrician the insulation can be a benefit, but for most users the static electricity that is stored in the wearer's clothes and body by this insulative quality can cause annoying and oftentimes painful electrical shocks when a place on the insulated body touches a grounding source.

Over the years many solutions to the ESD problem have been patented. Most have been primarily intended as industry solutions to the harmful affects that ESD can cause to electronic components. Some such U.S. Pat. Nos. 4,249,226 by Westberg, 5,191,505 by Gordon, 5,184,275 by Wiegel, 5,786,977 by Cohen, 6,307,727 by De Angelis, and 6,707,659 by Hee, are examples of these industry solutions that were acceptable industry solutions but ones that would never be worn in daily life for obvious aesthetic and safety reasons and in practice on common surfaces they would wear out very quickly. Most of these inventions also look uncomfortable to put on and to wear. A person who is a jogger or tennis player would probably be amused at all of the aforementioned inventions and would never consider them for reasons that would be obvious by a visual review of said inventions.

Still another industry solution was to apply a wristband to the person to be grounded, see U.S. Pat. No. 5,018,044 by Weiss as an example, but this solution "leashed" the worker to a very small area and again would not be practical in day-to-day life to control ESD. Again, most of the above solutions were intended as industry solutions for manufacturing concerns in the computer and electronics industries and were not intended for the users comfort or aesthetics of people in their day-to-day life.

Patents such as U.S. Pat. No. 4,785,371 by Edwards and U.S. Pat. No. 5,426,870 by Purnell were developed for the shoe manufacturers to eliminate the ESD problem by modifications to the manufacturing process and materials to facilitate a grounding effect in the shoe itself. These solutions would have been extremely costly to implement and one can presume this is the reason they are not commercially available.

Some inventions such as that disclosed in U.S. Pat. No. 4,727,452 by Brownlee, attempted to provide a grounding path as well as heat dissipation. This device would also be expensive, inflexible and uncomfortable as well as adding difficulty to size for all the various shoe sole thicknesses. Proper installation of this device in a proper location on the shoe may also have been a critical problem. This device also had a hard disk that made contact with the wearer's foot and the earth and substrate. This condition could cause injury to the foot when impacting a foreign object, such as a rock, or during a landing from a jump and could also cause a fall when the hard disk, which does not provide the traction of the otherwise soft sole of the shoe, makes contact with another hard surface such as linoleum or other hard surfaces. Additionally the hard disk in this invention once mounted to the sole of the shoe could mar floor coverings such as wood or vinyl. The aforementioned device also did not provide the resistance that is required to preclude an ESD event when moving from a non-grounded surface to a grounded surface.

SUMMARY OF THE INVENTION

The principal object of the present invention is that upon installation the current invention will provide a semi-continuous grounding path with a resistor to reduce or eliminate the electro static discharge (ESD) as a means for safely and painlessly releasing electrostatic currents that accumulate in the body and clothing of personnel. This accumulation is oftentimes significantly increased during certain climatic conditions such as low humidity and high-pressure areas in the atmosphere and is compounded by the introduction of static accumulators such as carpeting.

It is another object of the present invention that the application of the current invention will allow painless dissipation of ESD through a controlled grounding circuit and prevent the build-up of static electricity in the body and clothing of the wearer and prevent clothes from clinging caused by static electricity build-up and will aid in hair grooming while wearing nonconductive shoes as static electricity can oftentimes cause hair to be unmanageable.

It is another object of the present invention will prevent the painful shock that can be experienced when a part of the body touches a grounding source when a static charge has been stored in the wearer of unprotected shoes. A common occurrence is to touch a doorknob and have painful or at least annoying shock (and in some instances a dangerous arc) happen without warning.

It is yet a further object of the present invention that the retrofitting of shoes may be accomplished and easily installed by an average person with only minor mechanical skills on any footwear with a nonconductive sole to a conductive path disclosed in the present invention.

It is another object of the present invention that the moisture from normal perspiration of the foot in the shoe will provide a path from the foot through most socks, if and when socks are worn, after a relatively short period of time to the collection plate.

It is another object of the present invention that it will not affect the comfort of the shoe where the present invention has been properly installed.

It is a further object of the present invention that it will aid in the reduction of ESD damage to electrical and electronic components.

It is yet a further object of the present invention that it will aid in grounding an individual who is transferring liquids through non-conductive conduits such as, but not limited to rubber and other non-grounded hoses.

Briefly, the present invention includes a collection plate or disk of electrically conductive material that is fastened to a connector that continues this electrically conductive path to a resistor that connects to an additional connector that is also used for installation of the device within footwear. After installation, this connector is trimmed to the proper length and an electrically conductive room temperature vulcanizing compound (RTV) is applied, this RTV also serves as a sealant to keep moisture and debris from entering the shoe where the device has been installed.

In a first alternate embodiment of the present invention, the collection plate has added teeth to secure it to the shoe sole in a more stable fashion.

In a second alternate embodiment of the present invention, the connector is a rigid solid grounding element, and may include a sharpened point or spiked end to secure it to the shoe sole in a more stable fashion. In this embodiment the use of non-conductive material for embedding the conductor can be used.

In a third alternate embodiment of the present invention, the optional collection plate, optional joint, and optional connector are replaced with a single resistor wire.

This device consists of an accumulator, connectors, a resistor and a bed of electrically conductive RTV that provide a conductive path for static electricity to leave the body and clothing of the wearer painlessly by preventing ESD from occurring. The connectors may be made from solid wire, braided or stranded wire, or a conductive nonmetallic. Almost any material that conducts electrical current may be used to satisfy this intent.

DETAILED DESCRIPTION OF THE DRAWINGS

Figure 1:
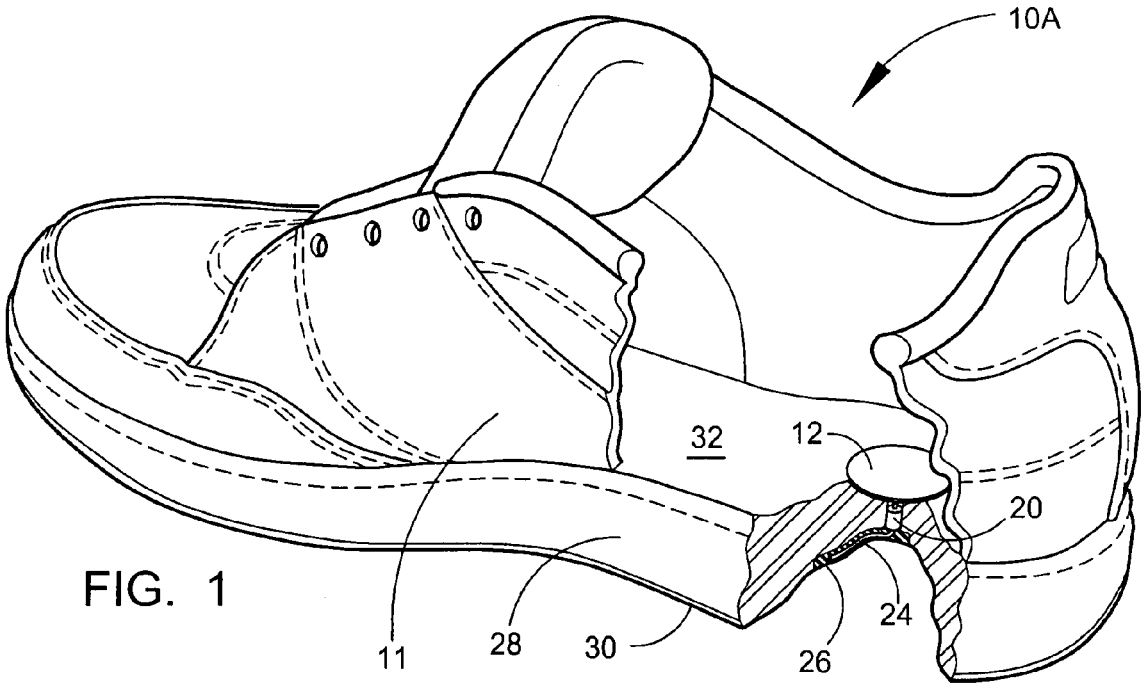
FIG. 1 is a perspective partially cross sectional view which depicts a deck shoe or an athletic shoe illustrating the current invention in place installed within the shoe, constructed in accordance with the present invention.

As required, detailed embodiments of the present invention are disclosed herein; however it is to be well known and understood these embodiments are only for examples and other features and advantages will become apparent by a skilled person in the arts. In the accompanying drawings there are various views and examples of the inventions possible forms and are not intended to be the only possible forms or shapes that this invention may be able to assume to accomplish the function that is disclosed herein.

Various materials such as metal, electrically conductive non-metallic materials (such as, but not limited to silicone, polyurethane, and cloth with conductive elements) wire, and conductive RTV may be used in practice and will still comply with the intent of this drawing. Every possible anticipated embodiment, reflecting the use of each material, is not demonstrated in the drawing figures, which are only intended for and are merely a means to demonstrate the claims and a representative basis for teaching a skilled person the basis of these claims.

The figures are not necessarily to scale and may be exaggerated or minimized to show the embodiment of the view in the attached drawings.

FIG. 1 shows a perspective partially cut-away view of the device assembly 10A that this invention embodies. The installation is in a deck shoe or an athletic shoe 11, but there are perhaps millions of different shoe designs and styles that have non-conductive soles for which this invention is intended as a solution for, and a deck shoe or an athletic shoe 11 was chosen to demonstrate the practical application of this invention. This view also shows the typical layers in a shoe for demonstration only. These layers comprise the shoe sole material 28, shoe outsole tread surface 30 and shoe inner insole surface 32. The collection plate 12 is located on the surface of the inner insole surface 32. Resistor 20 is within a void in the shoe sole material 28 that the end user adds to the shoe. A conductor 24 is located within the shoe outsole tread surface 30. This conductor 24 is embedded in an RTV 26 and exposed to the earthly ground through the tread surface 30 as is better shown and described in FIG. 4 below. The RTV to be used can be, but is not limited to silicon rubber or butyl rubber compounds available, such as SS-24 from Silicone Solutions, in Twinsburg, Ohio, RTV-60 from Con-Stockwell Elastomerics, Inc. in Philadelphia, Pa., or SSP 779 NG from Specialty Silicone Products, in Ballston Spa, N.Y., or any other like compounds.

Figure 3:
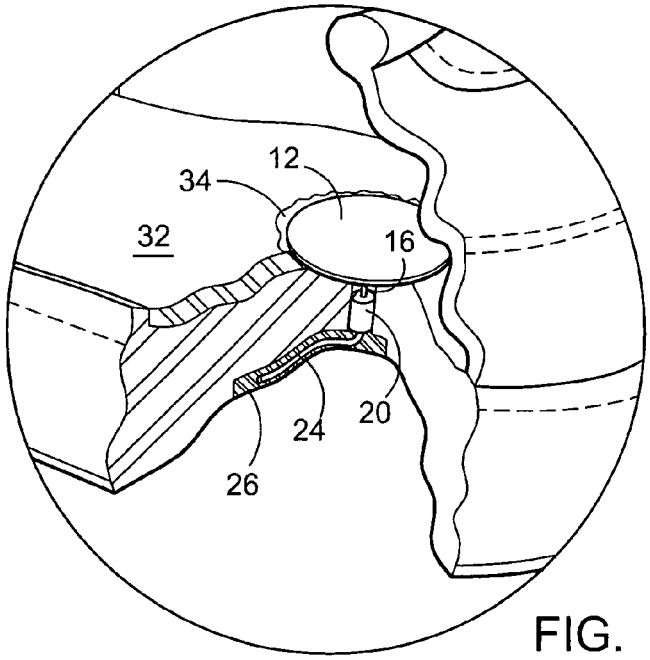
FIG. 3 depicts an enlarged cross-sectional view of the present invention device assembly installed in a shoe with the trimming and sealing completed, constructed in accordance with the present invention.

It should be understood that this invention can be used in any shoe with a non-conductive sole, and this view shown in FIG. 1 is to provide a reasonable representation of one of numerous the embodiments of the present invention to a person reasonably skilled in the related arts This view is intended to illustrate the typical application of the current invention and this view is further defined in FIG. 3, which is an enlarged close-up view of the current invention installed in this shoe 11.

Figure 2:
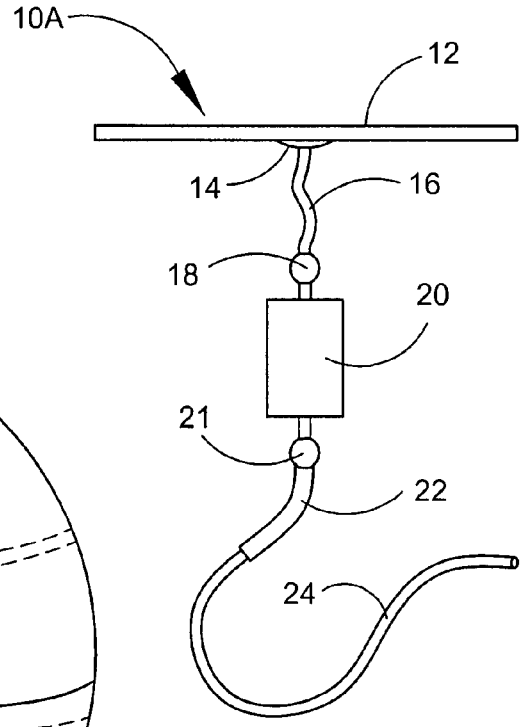
FIG. 2 illustrates a side elevational view of the complete invention assembly prior to installation depicting the component parts therein, constructed in accordance with the present invention.

FIG. 2 illustrates a side elevational view of the complete invention assembly 10A prior to installation depicting the component parts therein. This uninstalled view of the complete assembly 10A, includes the collection plate 12, the joint 14, to the first connector 16. Connector 16 is important because it provides not only an electrical transfer but also gives flexibility between the oftentimes softer inner insole surface 28 material and the much harder shoe outsole tread surface 30 material. Joint 18 secures the connector 16 to the resistor 20. This resistor 20 provides resistance to the high voltage from static electricity. This voltage may range from a few hundred volts in a mild stage of charge to the tens of thousands of volts in a high state of charge.

The greater the voltage the more severe the impact of an ESD event on the person carrying such voltage will be, once released to a grounding source without such a resistor. The insulation 22 as shown in this view of FIG. 2, has been partially removed but may be left on to aid in the installation of the assembly and can be removed after installation is complete.

The use of resistors in electrical theory is very well known and has been used successfully in electrical functions for many years of electrical history. The resistor 20 and the untrimmed conductor 24 are connected at a second joint 21, also covered in additional embodiments as described previously and below, and shows the electrical path for the ESD dissipation without showing the shoe or the electrically conductive RTV 26 for clarity. This view also shows joints 14, 18 and 21 in three places, which is only one method of connecting the components collection plate 12, connector 16, resistor 20, and conductor 24. In an alternate embodiment these components may be made as one piece (see alternate embodiments below for a complete description), or one or more of these components may be absent.

Still further methods of connecting the previously described components, such as but not limited to, include solder, glue, resins and swaging. Any method that secures the components in an acceptable conductive electrical path to a ground would satisfy the intent of this description.

Referring now to FIG. 3, this figure shows a cross-sectional close-up view of the completed assembly 10 installed in a shoe on the insole 32. This figure also more clearly shows the bed of adhesive material 34 (such as RTV, but also a non-conductive glue may be employed here) under the collection plate 12. This bed of conductive RTV or non-conductive adhesive 34 material will aid in holding disk 12 firmly in place and provide a secondary seal to prevent moisture and debris from entering the shoe. This view clearly shows the conductive path that static electricity will follow to leave the wearers body and clothing. This path begins at the collection plate 12 continues through flexible connector 16 and resistor 20 where the electrical voltage meets resistance to eliminate the adverse reaction associated with ESD. The reduced voltage then continues down flexible conductor 24 to the bed of conductive RTV 26 holding the embedded flexible conductor 24 in place, and is dissipated to the earth or other grounded source.

Figure 4:
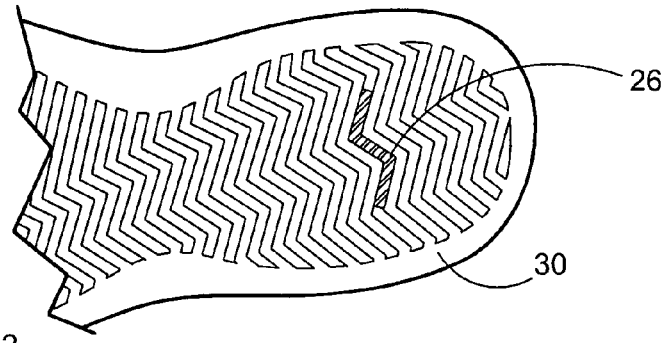
FIG. 4 illustrates a bottom view of a shoe with the wire covered by the conductive RTV in a typical shoe application, constructed in accordance with the present invention.

Referring now to FIG. 4, this view shows the electrical conductor 24 installed in the outer sole tread 30 of the shoe 11. While this view shows the conductor 24 following the path of the shoe tread it need only protrude slightly from the sole and tread surface 30 so as to make good electrical contact with the conductive RTV 26. The electrically conductive RTV is commercially available (see above for examples of products currently available) and any room temperature vulcanizing material that provides an electrical path to a source of ground that the shoe comes in contact will satisfy this requirement.

There are many thousands of different tread designs, and this view of the bottom of a shoe shown here in FIG. 4, depicts the conductor (hidden from view) embedded in the RTV 26, whereby the RTV 26 follows the contour of a recess or groove in the shoe tread 30, in one of many such tread designs. Any such tread design can be adapted for this use.

Again referring to FIG. 4, this view shows a bottom view of a deck shoe or athletic shoe, such as a tennis shoe, with the RTV 26 covering a typical installation for the current invention. This is only one of many thousands of different variations of the shoe soles where this invention could be mounted. The invention described herein can be installed and made functional in almost any type of shoe, boot, or other type of footwear with a non-conductive sole. This view is provided to give an example of how the current invention may be used in a practical application and to provide a basis for demonstrating the application for a person reasonably skilled in the arts.

Figure 5:
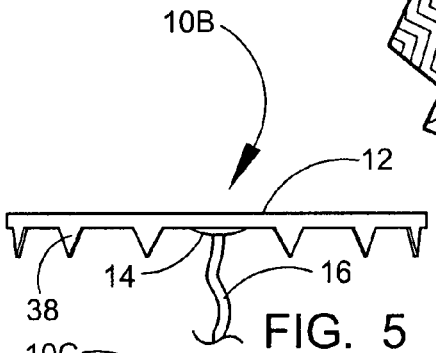
FIG. 5 illustrates a second embodiment showing the securing teeth incorporated into the collection plate, constructed in accordance with the present invention.

Referring now to FIG. 5, in an alternate embodiment teeth 38 are added to the lower surface of the collection plate 12. These teeth 38 add stability to the installed collection plate and prevent slipping.

Figure 6:
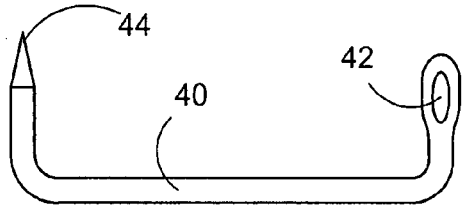
FIG. 6 shows a detailed view of a solid grounding element having a sharpened point thereon, constructed in accordance with the present invention.

FIG. 6 shows an alternate way of contacting a source of ground without the requirement of using conductive RTV at the earth ground contact point in the tread of the shoe so equipped. A solid conductor 40 made from a solid piece of copper, aluminum or other conductive material with one end formed in the shape of a keyway 42 for threading conductor 48 to secure to 40 and the other end formed in the shape of a sharpened point 44 to facilitate pressing the conductor through the tread 30 and into the sole 28. A non-conductive adhesive, 46, such as, but not limited to Shoe Goo® manufactured by Eclectic Products, Inc., and other like materials, used to permanently anchor 40 in place and prevent moisture and other foreign particles from entering the shoe.

Figure 7:
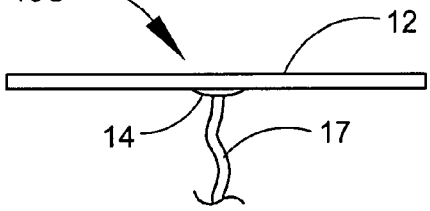
FIG. 7 depicts another alternate embodiment of the present invention in which a resistor type wire is used in place of all other optional components, constructed in accordance with the present invention.

Referring now to FIG. 7, this figure depicts another alternate embodiment of the present invention in which a resistor type wire is used in place of all other optional components, as shown and described in FIG. 2, above. In this embodiment, the connector 16, optional joint 18, the optional resistor 20, the optional joint 21, and the insulation 22 that lead up to the conductor 24 are all replaced by a single resistor wire 17 which does the job of all of the replaced optional components. This resistor wire 17, employed here, is similar to those resistor wires used in internal combustion engine spark plug wiring applications, and inherently acts as an electrical resistor.

To accommodate very thin-soled shoes, an alternate embodiment is a semi-conductive wire to eliminate connector 16, resistor 20 and conductor 24. In such a case, adding a semi-conductive wire 17 to replace the connector 16, resistor 20, and connective material conductor 24, is an alternative. In this case, the joint 14 would be a glue joint and the one wire with a resistance level of 10 sup 3 to 10 sup 8 Ohm's and would be used to replace the aforementioned components and provide the required resistance. It would be assembled to complete assembly of the current invention 10 or collection plate 12 feed through the sole 30 and would then thread directly into a solid conductor with an installation similar to FIG. 8, below.

Figure 8:
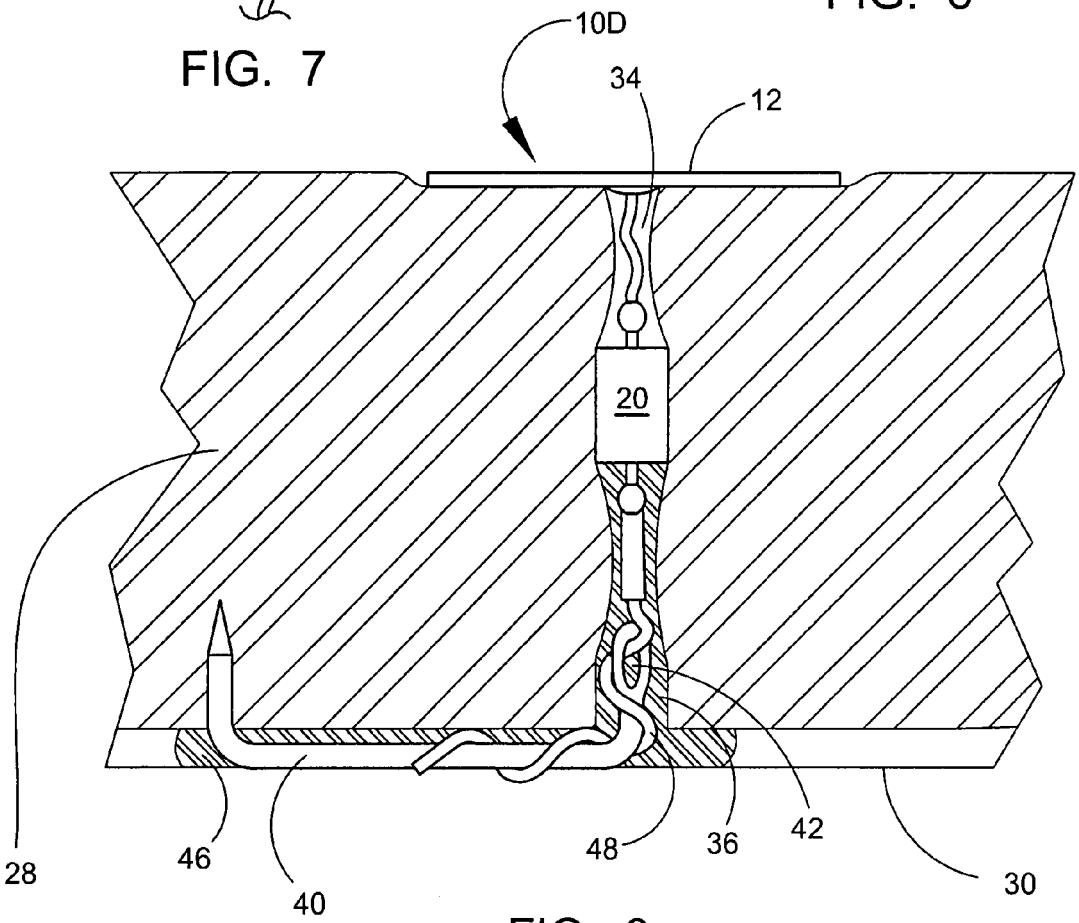
FIG. 8 shows the installation of this alternate embodiment of the device whereby electrical grounding is accomplished using the solid conductor as depicted in FIG. 6, constructed in accordance with the present invention.

Referring now to FIG. 8, the collection plate 12 is mounted as normal with electrical communication means running from the collection plate 12 to the resistor 20 through an upper void 34 in the shoe sole 28 material. The collection plate 12 may or may not be glued onto the shoe sole 28. The collection plate 12 may or may not employ teeth such as those shown in FIG. 5. If it is to be glued, it is anticipated that the adhesive material used will totally fill in, or partially fill in the upper void 32 to additionally seal the shoe sole from moisture and debris.

Conductor 48 can be twisted around solid conductor 40 and then pressed into the lower void 36 within the shoe sole 28. The other end of solid conductor 40 has a sharp point 44 that will anchor solid conductor 40 into the sole 28 of the shoe an still exposed externally to the shoe tread 30, by pressing it so that the sharp point 44 will penetrate deep into the sole 28 and will securely anchor it in place once the wearer applies his body weight to the shoe. In this embodiment, a non-conductive silicone sealant 46 may be used to fill in the lower void 36. The sealant material, as exemplified by silicone sealant 46 here, may be, but need not be conductive for this application in this embodiment configuration.

Generally, in operation, disclosed connectors 16 and 24 may be made from solid wire, braided or stranded wire, or a conductive nonmetallic material. Almost any material that conducts electrical current may be used to satisfy this intent for embodiments 10A, 10B and 10D.

Resistors 20 come in various Ohmage and voltages. Resistors of any practical size, voltage or Ohmage will provide similar results and the Ohmage and voltage are not a limiting factor in this invention. A resister of one-mega ohm and ½ volts was used for testing and it worked well. It was chosen primarily because of its size. Other resistors with other resistance values and voltages may be used to satisfy the intent of furnishing resistance to inhibit shocks and sparks since the current is being dissipated to a grounding source and is not used to change an electrical value such as in a circuit board where the desired output must be controlled.

The connectors and resisters can be applied to various locations around the accumulation collection disk 12 or in the center of the disk as shown. In practicality, joint 14 would be of greater value located towards the edge of 12 to allow greater flexibility in installing the present electrostatic discharge prevention device in various different tread designs. The location of joints and other component parts is not a matter of importance for this invention.

Finally, as an alternate embodiment, as described for 10C in FIG. 7, the entire assembly could be composed of a single piece of electrically conductive nonmetallic wire with a resistance value that would eliminate or greatly reduce the harmful effects of ESD. This one piece could then be inserted as described herein and sealed with the RTV 26 as previously described and shown in the attached figures. Such a device is an alternative embodiment to the configuration described herein and will satisfy the objectives and embodiments as previously disclosed.

A person skilled in the art will recognize from the foregoing specification that the present invention generates significant time savings during installations in footwear, because the times required to install the different types of electrostatic discharge prevention devices are significantly reduced. It will be further recognized that the present invention eliminates the need for wrist straps and for other externally worn wires during construction or refueling operations, and that the safety of wearers of the electrostatic discharge prevention device will be enhanced by reducing the possibility of sparks and arcing. Still further, it will be recognized that the present invention is suitable for use with all existing footwear, resistors, wires, and wiring methods, and complies with present safety codes.

Although these techniques and structures have been disclosed in the context of certain embodiments and examples, it will be understood by those skilled in the art that these techniques and structures may be extended beyond the specifically disclosed embodiments to other embodiments and/or uses and obvious modifications and equivalents thereof. Thus, it is intended that the scope of the structures and methods disclosed herein should not be limited by the particular disclosed embodiments described above.

We claim:

1. An electrostatic discharge device for installing in footwear comprising:

(a) a collection plate mounted to be flush with the inner sole surface of footwear, exposed for contact with a user, for accumulation of electrostatic energy within the user;

(b) a resistor for providing electrical resistance, in electrical communication with said collection plate; and (c) a conductor, in electrical communication with said resistor mounted in the lowermost portion of the footwear tread surface to provide an earthly ground wherein said conductor includes a solid U-shaped conductive material having a keyway at one end and a sharpened point at the opposite end;

whereby, the electrostatic energy is collected and accumulated by said collection plate and travels through said resistor to said conductor and into an earthly ground, greatly reducing or preventing electrostatic discharge from the body of the user.

2. The electrostatic discharge device for installing in footwear, according to claim 1, wherein said collection plate is fixed to the surface of the footwear inner sole using an adhesive material, to prevent movement of said collection plate.

3. The electrostatic discharge device for installing in footwear, according to claim 1, wherein said collection plate includes teeth mounted thereon, to prevent slipping of the collection plate when worn within footwear by a user.

4. The electrostatic discharge device for installing in footwear, according to claim 1, wherein said resistor is a conventional resistor commonly used in electrical component construction.

5. The electrostatic discharge device for installing in footwear, according to claim 1, wherein said resistor is a resistor wire.

6. The electrostatic discharge device for installing in footwear, according to claim 1, wherein said conductor includes an insulated conductive wire having the insulation partially removed.

7. The electrostatic discharge device for installing in footwear, according to claim 1, wherein said conductor includes a conductive wire having no insulation.

8. The electrostatic discharge device for installing in footwear, according to claim 1, wherein said conductor is embedded into the tread of footwear using conductive room temperature vulcanizing (RTV) compound.

9. The electrostatic discharge device for installing in footwear, according to claim 5, wherein said conductor is embedded into the tread of footwear using non-conductive sealant.

10. A method for making an electrostatic discharge device for installing in footwear, comprising the steps of:

(a) providing a collection plate mounted to be flush with the inner sole surface of footwear, exposed for contact with a user's foot, for accumulation of electrostatic energy within the user;

(b) providing a resistor for providing electrical resistance, in electrical communication with said collection plate; and (c) providing a conductor, in electrical communication with said resistor mounted in the lowermost portion of the footwear tread surface to provide an earthly ground wherein said step of providing a conductor includes the step of providing a conductor wherein said conductor includes a solid U-shaped conductive material having a keyway at one end and a sharpened point at the opposite end;

whereby, the electrostatic energy is collected and accumulated by said collection plate and travels through said resistor to said conductor and into an earthly ground, greatly reducing or preventing electrostatic discharge from the body of the user.

11. The method for an electrostatic discharge device for installing in footwear, according to claim 10, wherein said step of providing a collection plate fixed to the surface of the footwear inner sole, further includes the step of providing a collection plate fixed to the surface of the footwear inner sole using an adhesive material to prevent movement said collection plate.

12. The method for an electrostatic discharge device for installing in footwear, according to claim 10, wherein said step of providing a collection plate includes the step of providing a collection plate having teeth mounted thereon, to prevent slipping of the collection plate when worn within footwear by a user.

13. The method for an electrostatic discharge device for installing in footwear, according to claim 10, wherein said step of providing a resistor includes the step of providing a resistor wherein said resistor is a conventional resistor commonly used in electrical component construction.

14. The method for an electrostatic discharge device for installing in footwear, according to claim 10, wherein said step of providing a resistor includes the step of providing a resistor wherein said resistor is a resistor wire.

15. The method for an electrostatic discharge device for installing in footwear, according to claim 10, wherein said step of providing a conductor includes the step of providing a conductor wherein said conductor includes an insulated conductive wire having the insulation partially removed.

16. The method for an electrostatic discharge device for installing in footwear, according to claim 10, wherein said step of providing a conductor includes the step of providing a conductor wherein said conductor includes a conductive wire having no insulation.

17. The method for an electrostatic discharge device for installing in footwear, according to claim 10, wherein said step of providing a conductor includes the step of providing a conductor wherein said conductor is embedded into the tread of footwear using conductive room temperature vulcanizing (RTV) compound.

18. The method for an electrostatic discharge device for installing in footwear, according to claim 14, wherein said step of providing a conductor includes the step of providing a conductor wherein said conductor is embedded into the tread of footwear using non-conductive sealant.

* * * * *